US005775958A

United States Patent [19]

Luci

[11] Patent Number: 5,775,958

[45] Date of Patent: Jul. 7, 1998

[54] RETENTION INSERT FOR ELECTRICAL CONNECTOR

[75] Inventor: Benjamin Samuel Luci, Harrisburg, Pa.

[73] Assignee: The Whitaker Corporation, Wilmington, Del.

[21] Appl. No.: 770,036

[22] Filed: Dec. 19, 1996

[51] Int. Cl.[6] ..... H01R 13/436

[52] U.S. Cl. ..... 439/752

[58] Field of Search ..... 439/752, 595

[56] References Cited

U.S. PATENT DOCUMENTS

| | | | |
|---|---|---|---|
| 4,404,522 | 9/1983 | Pucciarello | 324/114 |
| 4,655,525 | 4/1987 | Hunt, III et al. | 339/63 M |
| 4,787,864 | 11/1988 | Hunt, III et al. | 439/595 |
| 5,569,055 | 10/1996 | Yamanashi et al. | 439/752 |

OTHER PUBLICATIONS

*AMP Catalog 82021*, "Circular Connectors for Commercial Signal and Power Applications . . . ", Revised Sep. 1996; pp. 36–39; AMP Incorporated, Harrisburg, PA.

*AMP Instruction Sheet IS 7582*, "Accessories for AMP Circular Plastic Connectors (CPC)", Dec., 1989; eight pages; AMP Incorporated, Harrisburg, PA.

*AMP Catalog 82623*, "MIL–C–5015 Style Circular Plastic Connector (CPC)"; Jun. 1991; six pages; AMP Incorporated, Harrisburg, PA.

*Primary Examiner*—Gary F. Paumen

*Attorney, Agent, or Firm*—Anton P. Ness

[57] ABSTRACT

A plurality of conductors (24) extend rearwardly from a rear face (18) of housing (12) of connector (10). One or more retention inserts (70) are assembled along portions of rear face (18) so that legs (74) thereof extend forwardly into passageways (20) alongside conductors (24) to be adjacent rear edges (42) of terminals (26) to secure the terminals in position if primary retention tines (38) are damaged.

6 Claims, 2 Drawing Sheets

RETENTION INSERT FOR ELECTRICAL CONNECTOR

FIELD OF THE INVENTION

This relates to the field of electrical connectors and more particularly to connectors for multiconductor cables.

BACKGROUND OF THE INVENTION

Circular connectors are known having a housing with a plurality of passageways extending from a mating face to a rear face, for respective conductors of a multiconductor cable each having a terminal terminated thereonto to be inserted into the passageways for the terminals to become seated such that their contact sections are disposed proximate the mating face to become mated with complementary terminals of a mating connector. It is common to provide such connectors with strain relief members for being affixed at the rear face to extend along rear portions of the conductors to the jacketed portion of the cable whereat the strain relief member is clamped to the outer jacket of the cable, and the strain relief member may be secured to the housing by being threaded thereonto.

Each terminal is conventionally secured in its respective passageway through retention tines formed along sides of each passageway extending forwardly and converging, that snap inwardly behind a collar of the terminal once the terminal is fully inserted into its passageway to latch rearwardly of the terminal collar. The retention tines are most easily molded onto a front face of a rearward housing member to extend forwardly from each passageway to a rear face of a forward housing member and partially into a corresponding passageway of the forward housing member. During assembly of the forward and rearward housing members, positioning tooling is known to cause damage to the protruding retention tines adjacent the opposed sides of the rearward housing member.

It is desired to continue use of a connector having damaged tines in one or more passageways.

SUMMARY OF THE INVENTION

The present invention provides a retention insert disposed along a portion of the rear face of the connector housing that includes multiple legs extending forwardly from a transverse base section each associated with a respective one of several adjacent passageways and aligned therewith, for each leg to extend forwardly into its respective passageway alongside the conductor to a rear edge of the terminal. With the base section secured along the rear face such as being held in position by the strain relief member, each leg of the insert will hold a respective terminal in position within the passageway if the primary retention system for the terminal is damaged. The retention insert is adapted to be positioned to fit alongside all conductors extending from the rear housing face, including those not associated with legs of the insert.

An embodiment of the present invention will now be described by way of example with respect to the accompanying drawings.

DETAILED DESCRIPTION

Figure 1:
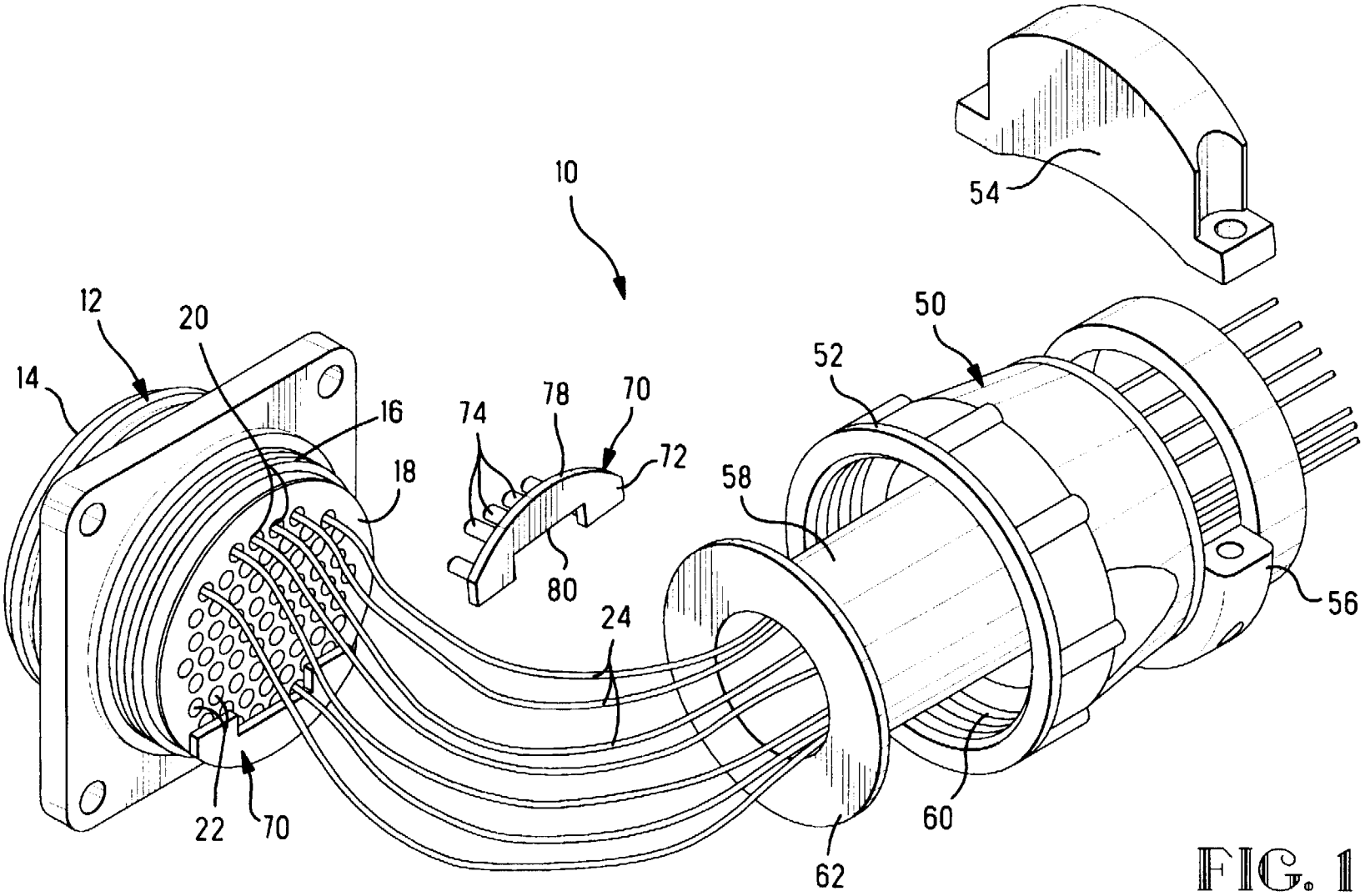
FIG. 1 is an isometric view of a connector assembly having an array of terminated conductors extending rearwardly therefrom and a strain relief member to be secured to the housing, with one retention insert of the present invention positioned in place and another exploded therefrom.

Connector assembly 10 includes a housing 12 having a mating face 14 and a rear portion 16 extending to a rear face 18, and a plurality of passageways 20,22 extending from mating face 14 to rear face 18. A representative number of a plurality of conductors 24 of a multiconductor cable, is shown, and each has a terminal (see FIG. 3) terminated thereonto such as by convention crimping, with the terminated conductor end portions inserted into respective passageways 20,22 of housing 12 so that contact sections of the terminals are disposed proximate mating face 14. A strain relief member 50 previously positioned along the jacketed portion of the cable, is threadable onto rear housing portion 16. Strain relief member 50 typically has a coupling ring section 52 at the forward end internally threaded to be threaded onto rear housing portion 16, a strain relief clamp 54 that is fastenable to the strain relief member at the rearward end or cable exit 56 clamped about a jacketed portion of the cable, and an elastomeric boot 58 for sealing the rear housing face 18 upon complete assembly.

Retention insert 70 of the present invention includes a base section 72 and a plurality of legs 74 extending forwardly to free ends 76 from base section 72 associated with respective passageways 20 adjacent each other about the periphery of the array at one portion of rear face 18. In FIG. 1 each retention insert 70 is dimensioned to complement a portion of rear face 18 adjacent the periphery thereof, with legs 74 located to be aligned with passageways 20. Several such retention inserts 70 may be used simultaneously, as shown. Base section 72 of each retention insert is transverse of limited axial dimension thereby extending minimally rearwardly from rear face 18 upon assembly.

Base section 72 extends from an outer or peripheral edge 78 that is profiled to complement the outer periphery of rear face 18, to an opposite or inner edge 80 that is profiled to conclude spaced from all conductors 24 extending from passageways 20 and also spaced from all other conductors 24 extending from passageways 22 not associated with any legs 74. The retention insert is thus adapted to be positioned in place adjacent the periphery of rear face 18 after all conductors have been inserted into their respective passageways of the housing.

Figure 2:
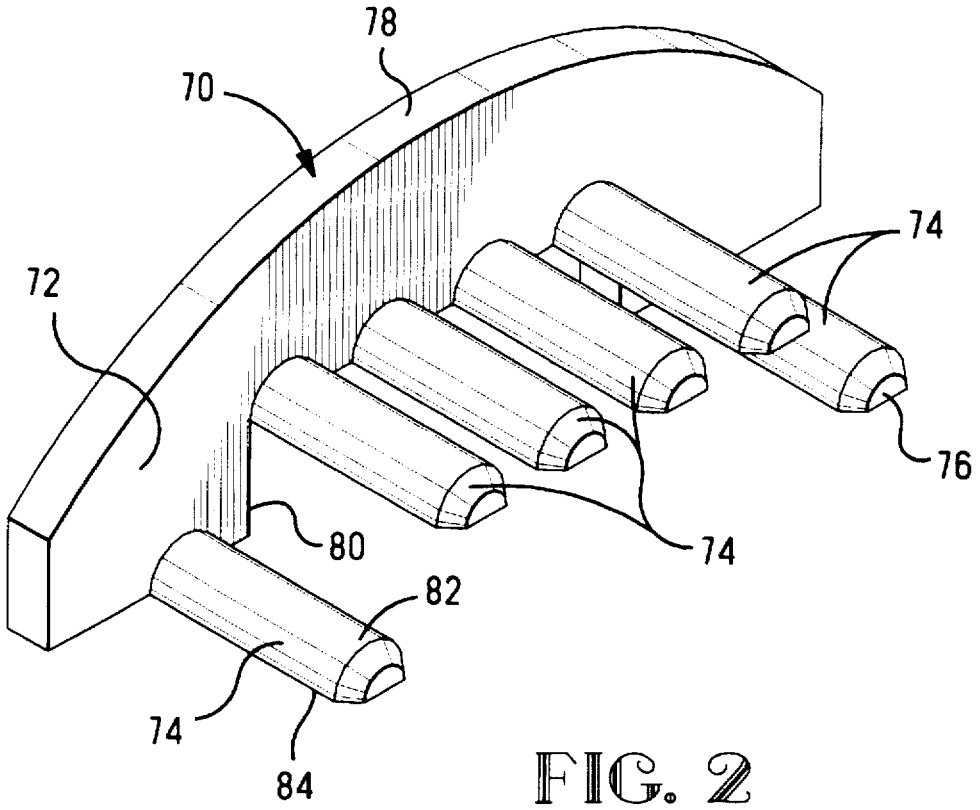
FIG. 2 is an enlarged isometric view of the retention insert of FIG. 1.

As seen in FIGS. 1 and 2, each leg 74 is shaped to complement an adjacent side wall of a passageway 20, and for cylindrically cross-sectioned passageways leg 74 would have a semicylindrical sidewall-proximate surface 82. Each leg 74 also has a conductor-proximate surface 84 that may be chordal, to extend alongside a conductor 24 so that it is insertable into a passageway 20 alongside a conductor 24 already in position extending along the passageway 20. With the passageways 20 with which a retention insert 70 is associated being along the outer periphery, the retention insert may be assembled along the rear face after the terminated conductors have already been inserted into their respective passageways 28.

Figure 3:
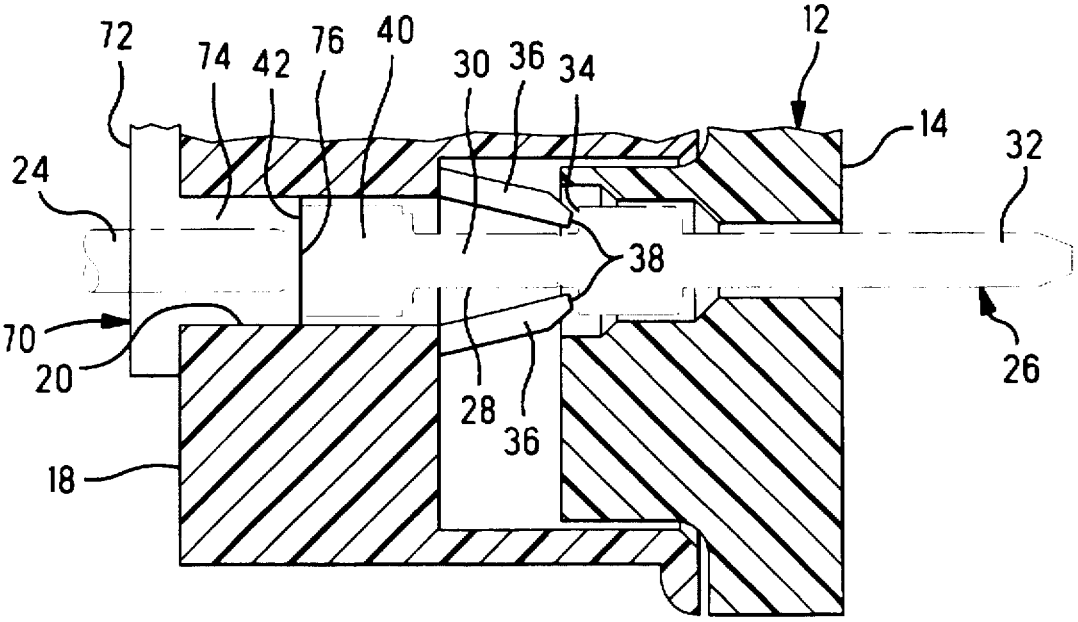
FIG. 3 is a longitudinal section view illustrating the retention insert in assembled position holding a terminal in position.

Referring now to FIG. 3, terminals 26 are shown to include a reduced diameter portion 28 along body section 30 rearwardly of contact section 32 whereby a rearwardly facing stop surface 34 is defined. The primary contact retention system comprises retention tines 36 extending forwardly along passageway 30 and converging at leading ends 38 that resile inwardly upon full contact insertion, to seat behind stop surface 34 preventing rearward terminal movement thereafter. Passageways 20 (and 22) are commonly larger in diameter than the conductors 24 to permit insertion of an extraction tool (not shown) into the passageway alongside the conductor 24 to extend alongside the enlarged rear terminal portion 40 to deflect the retention tines 36 outwardly releasing the terminal 26, after which the terminal may be pulled out of the passageway for inspection, repair and/or replacement without disturbing the other terminated conductors.

As demonstrated in FIG. 3, with the retention insert 72 in position, each leg 74 is received into a respective passageway 20 from rear face 18 alongside the conductor 24 until forward end 76 is disposed adjacent rear edge 42 of terminal 26 when base portion 72 is adjacent rear face 18 of housing 12. When strain relief member 50 is assembled to housing 12, forwardly facing surfaces 60 (FIG. 1) will compress a flange 62 of boot 58 against the rearwardly facing surface of the base section to secure it in position against rear housing face 18. A strain relief member not using a boot could engage a retention insert of the invention directly to clamp it into position upon complete connector assembly.

As can be seen in FIG. 1, several such retention inserts are usable simultaneously to assure retention of many of the terminals located in passageways 28 about the periphery of the array, with the legs of the retention inserts selectively positioned to correspond with the passageway locations of a selected portion of the rear housing face 18.

What is claimed is:

1. A combination of a multiconductor cable connector and a retention insert therefor, comprising:

the cable connector including a housing having an array of passageways extending between a mating face and a rear face; and the retention insert comprising an integral member having a transverse base section and a plurality of legs extending forwardly therefrom associated with several respective ones of said passageways adjacent a periphery of said housing rear face and spaced from remaining ones thereof, said member adapted to be located along said housing rear face for said legs to be inserted into said several ones of said passageways, said base section extending between a peripheral edge and an inner edge and being shaped and dimensioned to correspond with a portion of said housing rear face adjacent a periphery thereof, said portion containing only said several ones of said passageways, said inner edge concluding prior to traversing any other ones of said passageways which are farther from said periphery when assembled to said housing, and said legs extending from adjacent said inner edge and said inner edge traverses said housing rear face adjacent said several passageways;

each said leg being shaped and dimensioned to extend into and closely along a side wall of a respective said passageway, alongside a conductor already positioned in and along said passageway, whereby said retention insert is adapted to be assembled to said housing along said rear face after said conductors already extend rearwardly therefrom, with said legs extending forwardly into said respective passageways when said base section is disposed along and adjacent said housing rear face, and thereafter secure terminals on said conductors in position along said several passageways when said retention insert is then secured in position.

2. The combination as set forth in claim 1 wherein an inner edge of said base section coincides with conductor-proximate surfaces of all said legs.

3. The combination as set forth in claim 1 wherein at least one said leg is positioned to be offset from a row of at least three others of said legs.

4. The combination as set forth in claim 1 wherein sidewall-proximate surfaces of all said legs face in a common direction, and conductor-proximate surfaces of all said legs face in a common opposite direction.

5. The combination as set forth in claim 4, wherein each said leg is semicylindrical to complement a sidewall of a passageway of circular cross-section.

6. A retention insert for a multiconductor cable connector, the connector being of the type including a housing having an array of passageways extending between a mating face and a rear face, comprising:

an integral member having a transverse base section and a plurality of legs extending forwardly therefrom associated with respective passageways and located to be aligned therewith along said housing rear face, said base section shaped and dimensioned to correspond with a portion of said housing rear face adjacent a periphery thereof and containing only said respective passageways, and each said leg being semicylindrical to complement a side wall of a respective said passageway of circular cross-section, said leg to extend alongside a conductor already positioned in and along said passageway, whereby said retention insert is assembled to said housing along said rear face when said conductors extend rearwardly therefrom, with said legs extending forwardly into said respective passageways when said base section is disposed along and adjacent said housing rear face, and secure terminals on said conductors in position along said passageways when said combination insert is then secured in position.

* * * * *

UNITED STATES PATENT AND TRADEMARK OFFICE

CERTIFICATE OF CORRECTION

PATENT NO. : 5,775,958

DATED : July 7, 1998

INVENTOR(S) : Benjamin S. Luci

It is certified that error appears in the above-identified patent and that said Letters Patent is hereby corrected as shown below:

Column 2, line 60, change "28" to --20--.

Column 2, line 66, change "30" to --20--.

Column 3, line 25, change "30" to --20--.

Signed and Sealed this

Second Day of March, 1999

*Attest:*

Q. TODD DICKINSON

*Attesting Officer*

*Acting Commissioner of Patents and Trademarks*